US008821141B2

(12) United States Patent
Helgeson et al.

(10) Patent No.: US 8,821,141 B2
(45) Date of Patent: Sep. 2, 2014

(54) POSITIVE DISPLACEMENT ROTARY PUMPS WITH IMPROVED COOLING

(75) Inventors: Bruce Helgeson, Dysart, IA (US); Joe Thompson, Cedar Falls, IA (US); Jim Mayer, Cedar Falls, IA (US); Chris Mihm, Cedar Falls, IA (US); Keith Feeley, St Leonards on Sea (GB); Juan Jose Mejia, Munich (GB)

(73) Assignee: Wright Flow Technologies Limited, Eastbourne (GB)

( * ) Notice: Subject to any disclaimer, the term of this patent is extended or adjusted under 35 U.S.C. 154(b) by 387 days.

(21) Appl. No.: 13/167,016

(22) Filed: Jun. 23, 2011

(65) Prior Publication Data

US 2012/0328462 A1 Dec. 27, 2012

(51) Int. Cl.
*F04C 15/00* (2006.01)
*F04C 2/12* (2006.01)

(52) U.S. Cl.
CPC ..... *F04C 2/126* (2013.01); *F04C 15/0096* (2013.01); *F04C 15/0073* (2013.01); *F04C 2240/605* (2013.01); *F04C 15/0038* (2013.01); *F04C 2240/51* (2013.01)
USPC ..... 418/104; 418/1; 277/306; 415/111

(58) Field of Classification Search
USPC ..... 277/61, 65, 375, 306; 415/111; 418/1, 418/206.1
See application file for complete search history.

(56) References Cited

U.S. PATENT DOCUMENTS

| | | | | | |
|---|---|---|---|---|---|
| 2,228,933 | A * | 1/1941 | Thomson | 418/206.4 |
| 3,136,558 | A * | 6/1964 | Wade | 277/394 |
| 3,419,279 | A | 12/1968 | Tracy | |
| 3,478,689 | A | 11/1969 | Ball | |
| 4,466,619 | A | 8/1984 | Adams | |
| 4,746,267 | A | 5/1988 | Higgins | |
| 5,005,990 | A * | 4/1991 | Wotring | 384/130 |
| 5,088,891 | A | 2/1992 | Brown et al. | |
| 5,238,253 | A * | 8/1993 | Sieghartner | 277/408 |
| 6,196,814 | B1 | 3/2001 | Cooksey et al. | |
| 7,878,509 | B2 * | 2/2011 | Takahashi | 277/359 |
| 7,993,118 | B2 * | 8/2011 | Prior et al. | 418/91 |
| 2008/0018055 | A1 | 1/2008 | Moldt et al. | |
| 2009/0304540 | A1 | 12/2009 | Whittome et al. | |
| 2010/0090412 | A1 * | 4/2010 | Scott et al. | 277/375 |
| 2011/0024987 | A1 * | 2/2011 | Crowley | 277/306 |

FOREIGN PATENT DOCUMENTS

EP 133204 B1 5/2007

* cited by examiner

*Primary Examiner* — Thomas Denion
*Assistant Examiner* — Thomas Olszewski
(74) *Attorney, Agent, or Firm* — Miller, Matthias & Hull LLP

(57) ABSTRACT

Various rotary pumps are disclosed that are designed to pump viscous fluids or slurries. Often, the seals of such pumps can become over heated. The disclosed pumps include slots disposed in the rotors and/or slots disposed in the openings through which the drive and driven shafts task so that some of the fluid being pumped through the pumping chamber can migrate through the proximal wall of the pump casing to the seal assemblies disposed on the other side of the proximal wall of the pump casing. Thus, the seal assemblies of the pumps are cooled without resorting to the use of a cooling jacket or other cooling mechanism.

12 Claims, 6 Drawing Sheets

FIG. 1
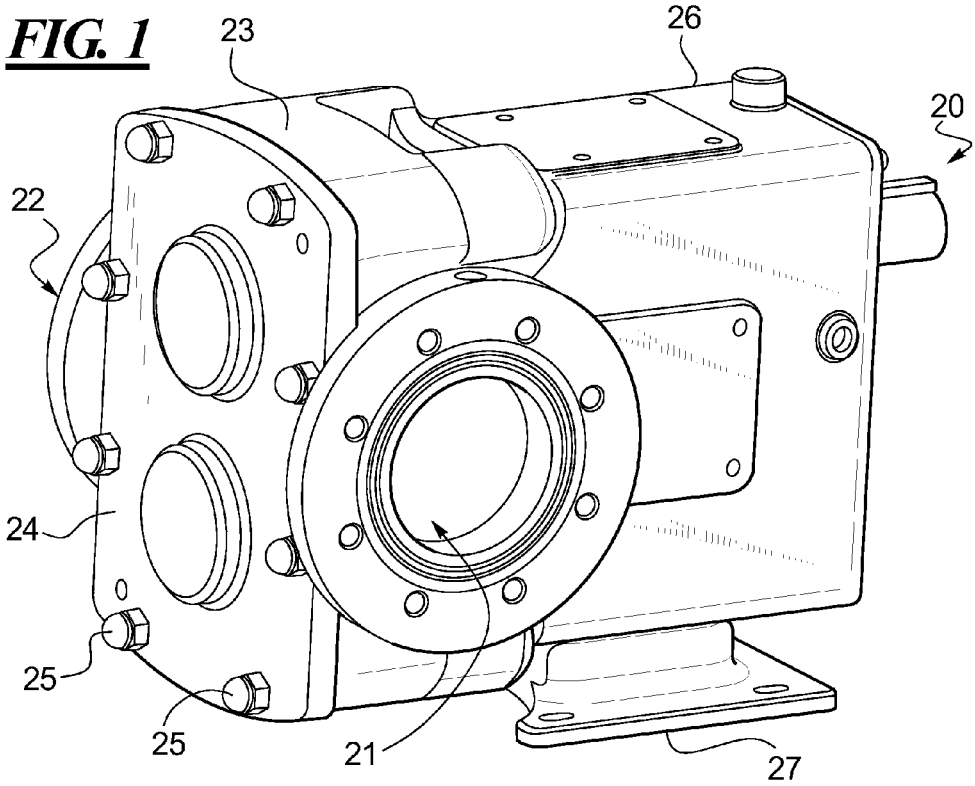
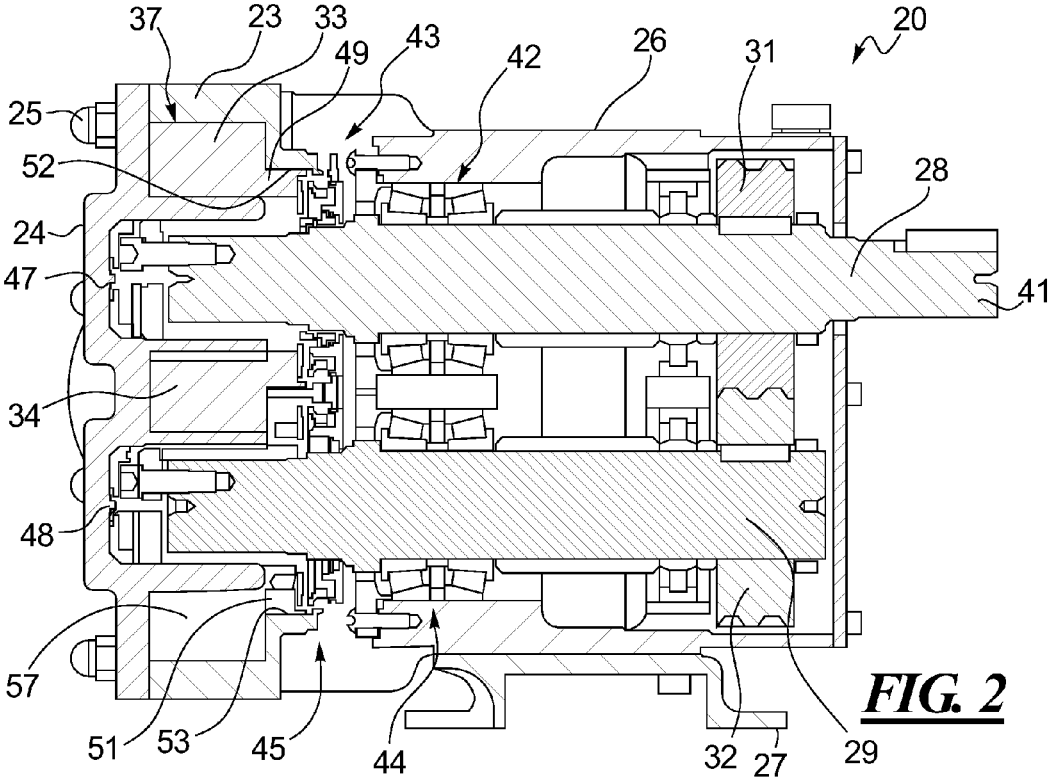
FIG. 2

POSITIVE DISPLACEMENT ROTARY PUMPS WITH IMPROVED COOLING

TECHNICAL FIELD

This disclosure relates generally to positive displacement rotary pumps. More specifically, this disclosure relates to an optimal seal and improved cooling for such pumps.

BACKGROUND

A positive displacement pump causes a fluid to move by trapping a fixed amount of the fluid and then forcing or displacing the trapped volume through a discharge outlet. Positive displacement rotary pumps are pumps that move fluid using the principles of rotation. At the inlet to the pump, the rotation captures and draws in the fluid before it is trapped and passed through the outlet. Various types of rotary pumps are available, including, but not limited to internal and external gear pumps, screw pumps, flexible vane or sliding vane pumps, liquid ring vacuum pumps, circumferential piston pumps, rotary lobe pumps etc. While this disclosure uses rotary lobe pumps and circumferential piston pumps as primary examples, one skilled in the art will realize that the principles disclosed herein are applicable to other types of rotary pumps as well.

Rotary lobe pumps (RLPs) are used in a variety of industries including, pulp and paper, chemical, food, beverage, pharmaceutical, and biotechnology. They are popular in these diverse industries because they offer sanitary qualities, high efficiency, reliability, corrosion resistance, and good clean-in-place and sterilize-in-place (CIP/SIP) characteristics.

RLPs offer a variety of rotor options including single, bi-wing, tri-lobe and multi-lobe rotors and lobes of different shapes. While RLPs are similar to external gear pumps in operation because both pumps employ two rotors and fluid flows around the interior of the casing. Unlike the gears of an external gear pump rotor, the lobes of the RLP rotor do not make contact. Lobe contact is prevented by external timing gears located in the gearbox.

As the two rotors of an RLP rotate, the lobes come in and out of mesh. As the lobes come out of mesh near the inlet port, they create expanding volume on the inlet side of the pump. Material flows into the cavity and is trapped by the lobes as they rotate. Pumped material travels around the interior of the casing in the pockets between the lobes and the casing. Finally, near the outlet port, the lobes go back into mesh, which forces material through the outlet port under pressure.

The gentle pumping action provided by the non-contacting lobes minimizes product degradation. RLPs also have large pumping chambers, allowing them to handle solids without damaging the solids. RLPs are used to handle slurries, pastes, and a wide variety of other liquids. If wetted, RLPs are self-priming RLPs also offer reversible flows and can operate dry for long periods of time. Flow is relatively independent of changes in process pressure, so output is constant and continuous.

Like an RLP, a circumferential piston pump (CPP) also has two rotors that are timed like rotary lobe pumps. A primary difference between a CPP and an RLP lies in the rotors and the casing. In a CPP, the rotors include wings (referred to as "pistons") that rotate in annular or cylindrical chambers (or simply, "cylinders") machined into the pump casing. This provides a large sealing surface between the pistons and the cylinders which minimizes slip. Because, CPPs have only two moving parts within the fluid chamber like RLPs, they have proven reliable. There is no sealing contact between the piston surfaces, which, like an RLP, distinguishes CPPs from gear and screw pumps; however, the CPP pistons make sealing contact with the cylinders machined into the pump housing. Similar to an RLP, external timing gears synchronize the movement of the rotors.

Like an RLP, as the CPP rotors rotate on the inlet side, the rotor pistons come out of mesh creating an expanding volume that draws the liquid into the pump. The liquid is forced out the outlet port by the collapsing cavity on the outlet side caused by the rotor pistons going back into mesh.

One disadvantage common to RLPs, CPPs and other rotary pumps is overheating of the shaft seals when pumping viscous fluids, leading to excessive seal wear and premature seal failure. Accordingly, rotary pump designs that optimize cooling and maximize seal life are needed to overcome this problem.

SUMMARY OF THE DISCLOSURE

Various rotary pumps are disclosed. One disclosed pump comprises at least one rotor that is disposed within a casing. The casing comprises a proximal wall. A drive shaft passes through a proximal drive shaft seal before passing through an opening in the proximal wall of the casing before being coupled to the rotor. The rotor comprises a hub for accommodating the drive shaft. The opening of the casing rotatably accommodates the hub. The hub includes a slot for permitting fluid to pass through the slot and through the proximal wall of the casing before reaching the proximal drive shaft seal.

Another disclosed pump comprises first and second rotors that are disposed within a casing. The casing also comprises a proximal wall. A drive shaft passes through a proximal drive shaft seal before passing through a first opening in the proximal wall of the casing before being coupled to a first rotor. Similarly, a driven shaft passes through a proximal driven shaft seal before passing through a second opening in the proximal wall of the casing before being coupled to a second rotor. The first and second rotors each comprise a hub for accommodating the drive and driven shafts respectively. The first and second openings of the casing rotatably accommodate the hubs of the first and second rotors respectively. The hubs of the first and second rotors each include a slot for permitting fluid to pass through the slots and through the proximal wall of the casing before reaching the proximal drive and driven shaft seals.

In a refinement, the first and second openings in the proximal wall of the casing also includes a slot for permitting fluid to pass through the proximal wall of the casing to the proximal drive and driven shaft seals. In another refinement, both openings include such a slot for permitting fluid to pass through the proximal wall of the casing. In still another refinement, the hubs of both the first and second rotors each comprise a slot for permitting fluid to pass through the proximal wall of the casing. In another refinement, both hubs and both openings all include slots for permitting fluid to flow from the casing, past the proximal wall of the casing to the proximal drive and driven seals.

In a refinement, the rotors are circumferential piston rotors. In another refinement, the rotors are lobe rotors.

Another rotary pump is disclosed that comprises first and second rotors disposed in a casing. The casing comprises a proximal wall. A drive shaft passes through a proximal drive shaft seal before passing through a first opening in the proximal wall of the casing before being coupled to a first rotor. A driven shaft passes through a proximal driven shaft seal before passing through a second opening in the proximal wall of the casing before being coupled to a second rotor. The first and second rotors each comprise a hub for accommodating the drive and driven shafts respectively. The first and second openings of the casing also rotatably accommodate the hubs of the first and second rotors respectively. At least one of the first and second openings comprises a slot for permitting fluid to pass through the proximal wall of the casing to the drive and driven proximal shaft seals. A method for cooling the drive and driven shaft seals of a rotary pump is disclosed. The method includes providing a rotary pump as described above and placing a slot in at least one hub of the first and second rotors from permitting fluid to pass through the slot and through the proximal wall of the casing before reaching the proximal drive and driven shaft seals.

Another method for cooling the drive and driven shaft seals of a rotary pump is disclosed that comprises providing the rotary pump as described above and placing a slot in at least one of the openings for permitting fluid to pass through the slot and through the proximal wall of the casing before reaching the proximal drive and driven shaft seals.

Thus, pumps and methods are disclosed that include the use of slots in one or both hubs of one or both rotors, in one or both openings, a combination of slots in the rotors and openings and a combination of slots in both rotors and both openings. Further, more than one slot may be placed in any hub or opening.

BRIEF DESCRIPTION OF THE DRAWINGS

FIG. 1 is a perspective view of a disclosed rotary pump.

FIG. 2 is a sectional view of the pump disclosed in FIG. 1.

DETAILED DESCRIPTION

Figure 3:
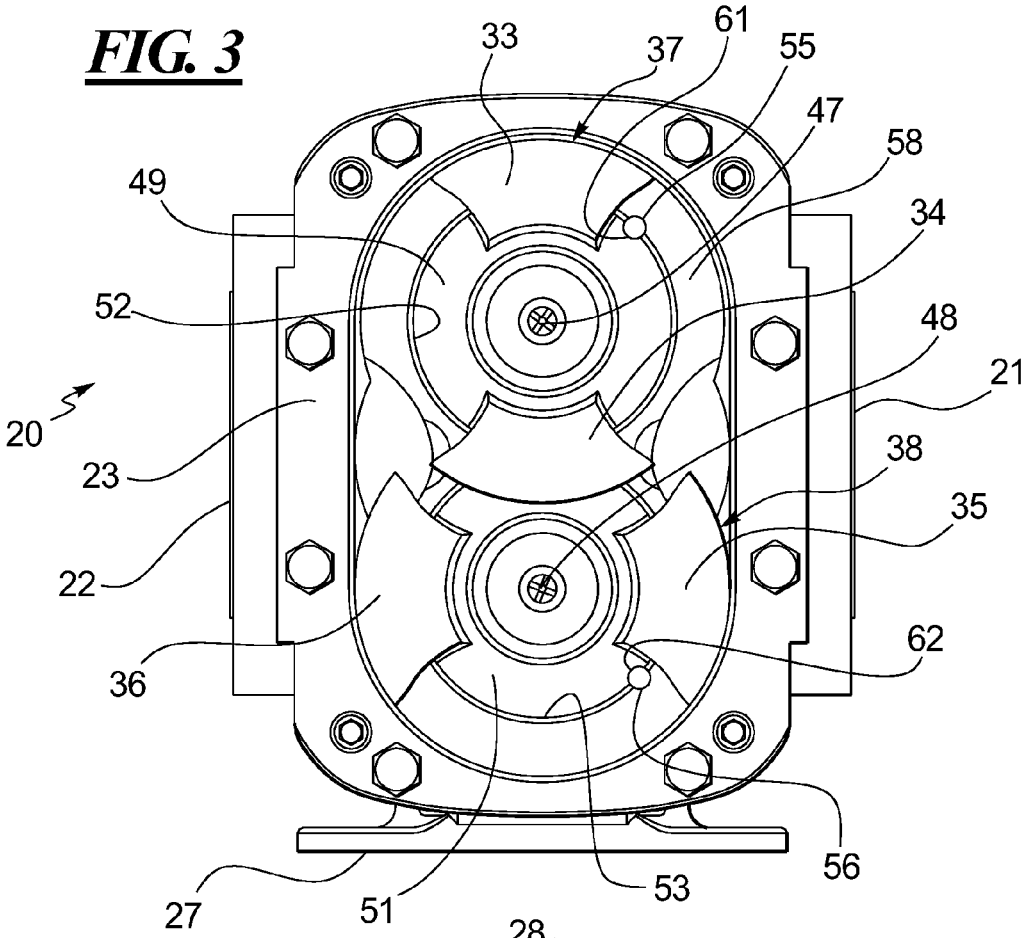
FIG. 3 is an end view of the pump disclosed in FIGS. 1 and 2 with the head cover removed thereby exposing the rotors which, in this case, are circumferential piston rotors.

FIG. 1 is a perspective view of a rotary pump 20 made in accordance with this disclosure. The pump 20 includes an inlet 21 and an outlet 22. The inlet and outlet 21, 22 lead to a rotor casing 23. The rotor casing 23 is enclosed at its distal end by a head cover 24. The head cover 24 is fastened to the casing 23 with a plurality of fasteners shown at 25. Opposite the casing 23 from the head cover 24 is a gear box 26. The pump 20 is supported by a pedestal 27.

Returning to FIG. 2, while the rotary pump 20 also includes a drive shaft 28 and a driven shaft 29, this disclosure is also applicable to rotary pumps with just a drive shaft 28, such as an internal gear pump (not shown). In FIG. 2, the drive and driven shafts 28, 29 are coupled together by timing gears 31, 32 respectively. Using the gears 31, 32, the rotation of the shafts 28, 29 is timed so that the pistons or wings 33-36 of the rotors 37, 38 do not touch or otherwise engage one another while the shafts 28, 29 are rotated.

The proximal end 41 of the drive shaft 28 is coupled to a motor (not shown). After passing through the timing gear 31, the drive shaft passes through a bearing assembly 42 before passing through the proximal drive shaft seal assembly 43. Similarly, the driven shaft 29 passes through the timing gear 32 before passing through the bearing assembly 44 before passing through the proximal driven shaft seal assembly 45. The rotor 37 is connected to the drive shaft 28 by the fastener 47 as the rotor 38 is connected to the driven shaft 29 by the fastener 48 as shown in FIGS. 2 and 3. Also shown in FIG. 2 are the hubs 49, 51 of the rotors 37, 38 respectively. The hubs 49, 51 are rotatably accommodated within the openings 52, 53 which lead to the seal assemblies 43, 45.

Figure 4:
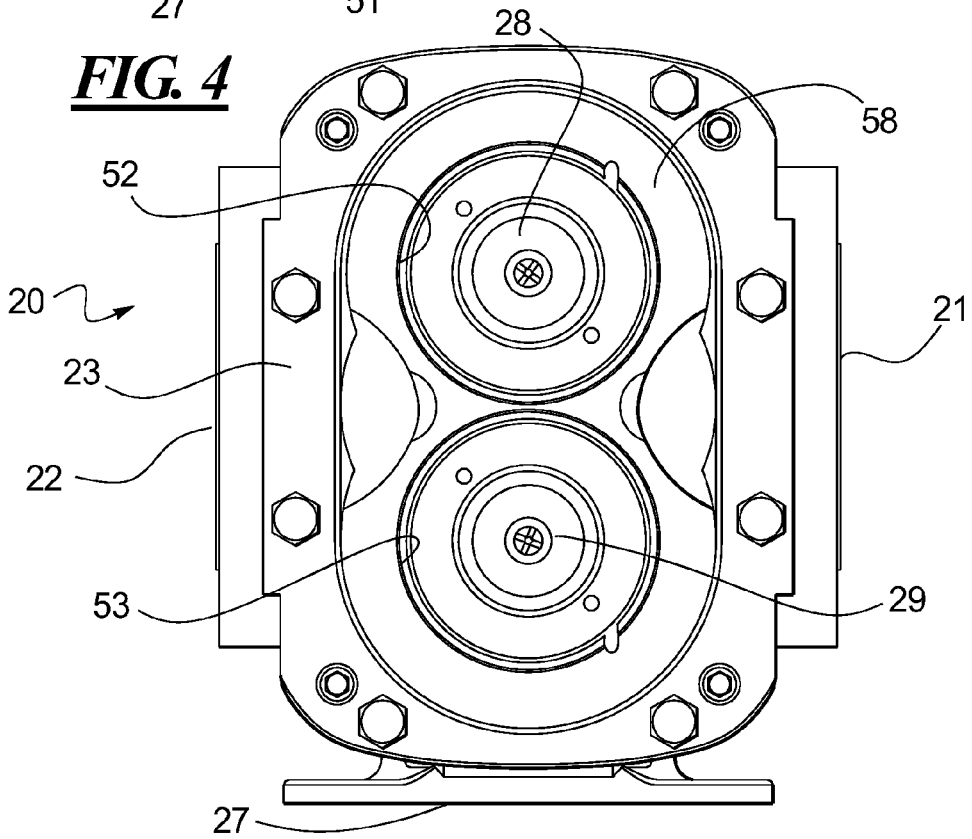
FIG. 4 is another end view of the pump disclosed in FIGS. 1-3, with the rotors removed.
Figure 5:
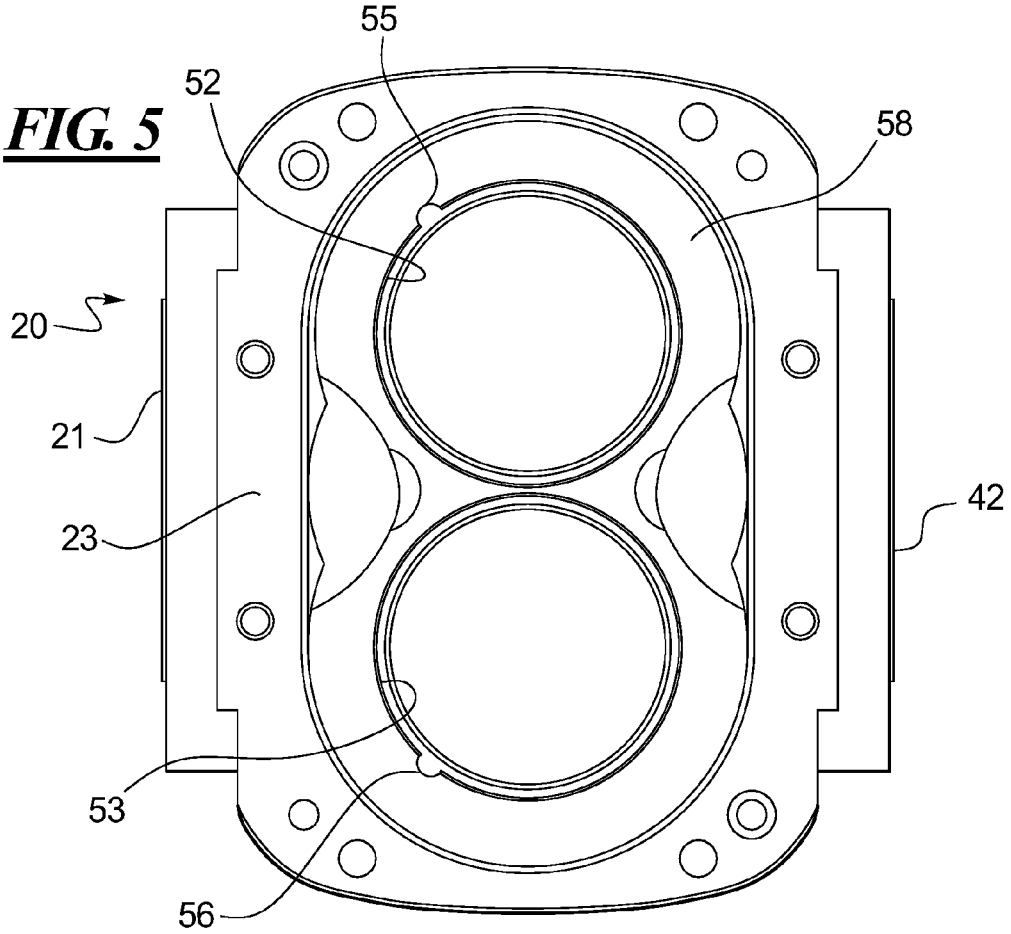
FIG. 5 is a rear view of the casing of the pump disclosed in FIGS. 1-4.
Figure 6:
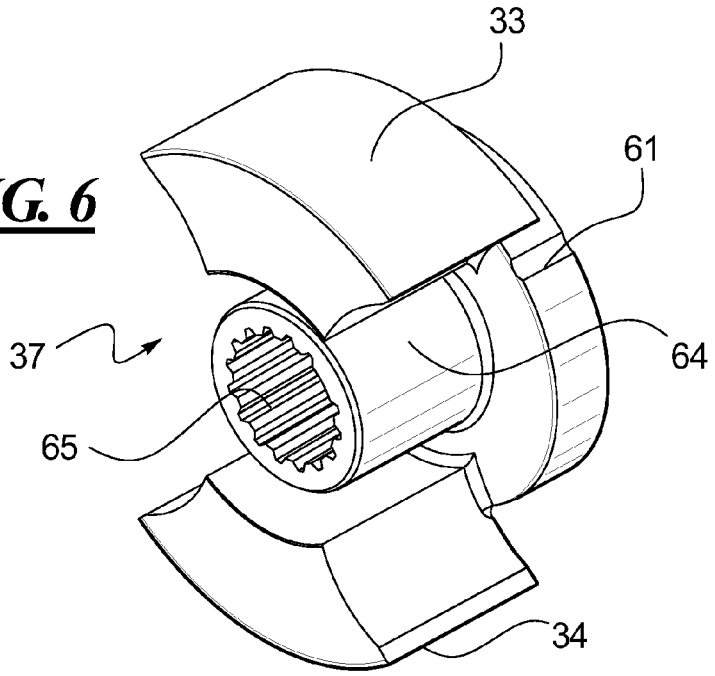
FIG. 6 is a perspective view of a circumferential piston rotor.
Figure 7:
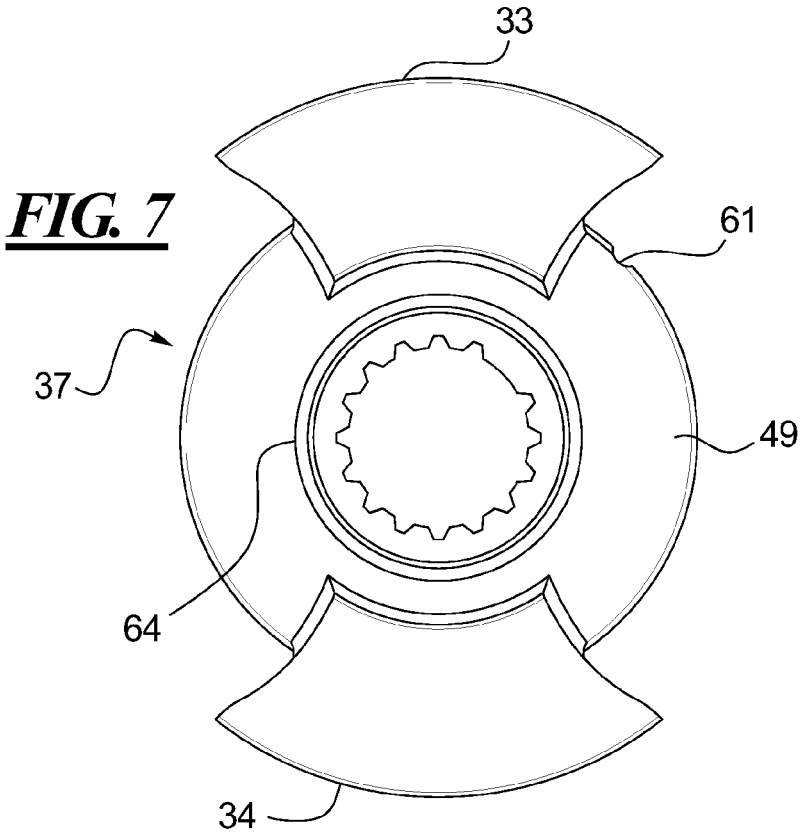
FIG. 7 is a top plan view of the rotor disclosed in FIG. 6.
Figure 8:
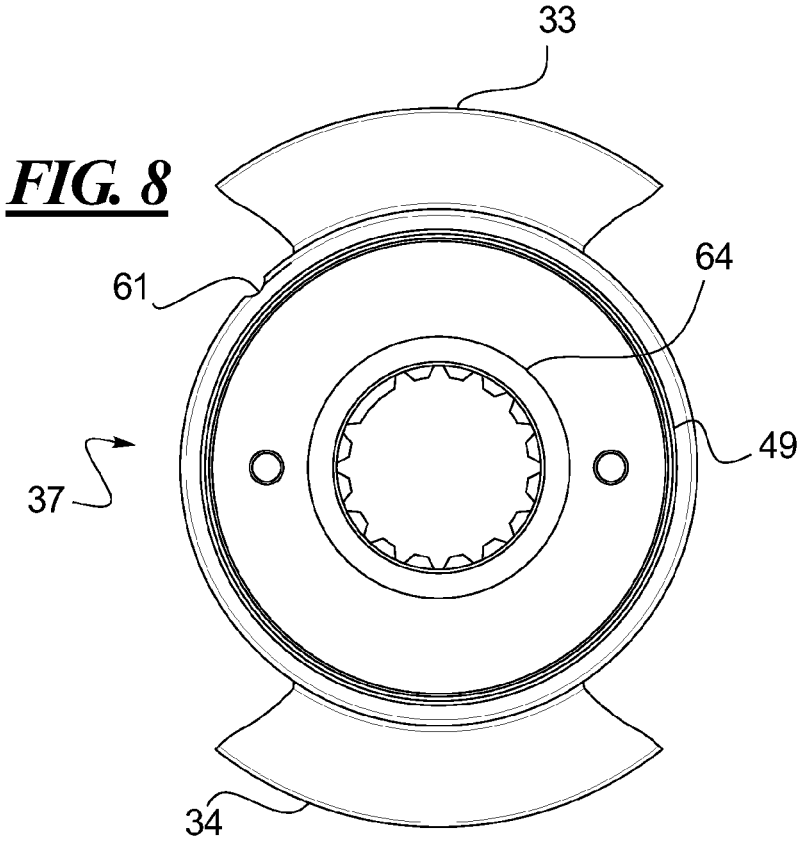
FIG. 8 is a rear plan view of the rotor disclosed in FIGS. 6-7.
Figure 9:
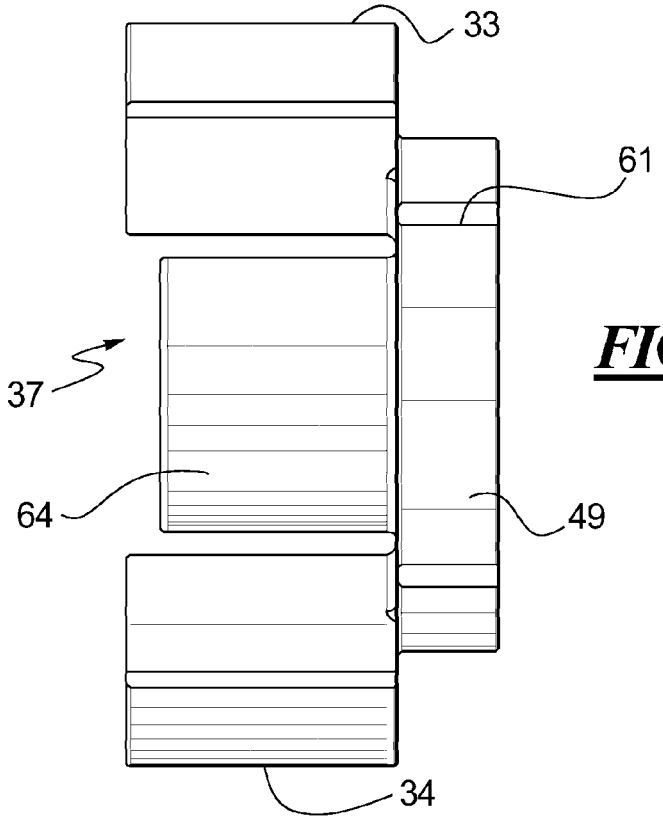
FIG. 9 is a side view of the rotor disclosed in FIGS. 6-8.

Returning to FIGS. 3-5, the means for cooling the seal assemblies 43, 45 while the pump 20 is pumping viscous fluids or slurries is disclosed. Returning to FIG. 3, the openings 52, 53 which accommodate the hubs 49, 51 are equipped with slots 55, 56 which allow fluid to pass from the pump chamber 57 and through the proximal wall 58 of the rotor casing 23. In addition to slots 55, 56 disposed at the periphery of the openings 52, 53, slots 61, 62 may also be placed at the periphery of the hubs 49, 51 as illustrated in FIG. 3. Thus, multiple combinations are available. A single slot 61, 62 could be placed in one of the hubs 49, 51, slots 61, 62 could be placed in each hub 49, 51, a single slot 55 or 56 could be placed at the periphery of one of the openings 52, 53, slots 55, 56 could be placed at each opening 52, 53 and various combinations thereof.

FIGS. 6-9 show the location of a slot 61 disposed in the hub 49 of the rotor 37. The rotor 37 also includes wings or pistons 33, 34 disposed on either side of a collar 64 which includes a splined interior 65 for securing the rotor 37 to the drive shaft 28.

Figure 10:
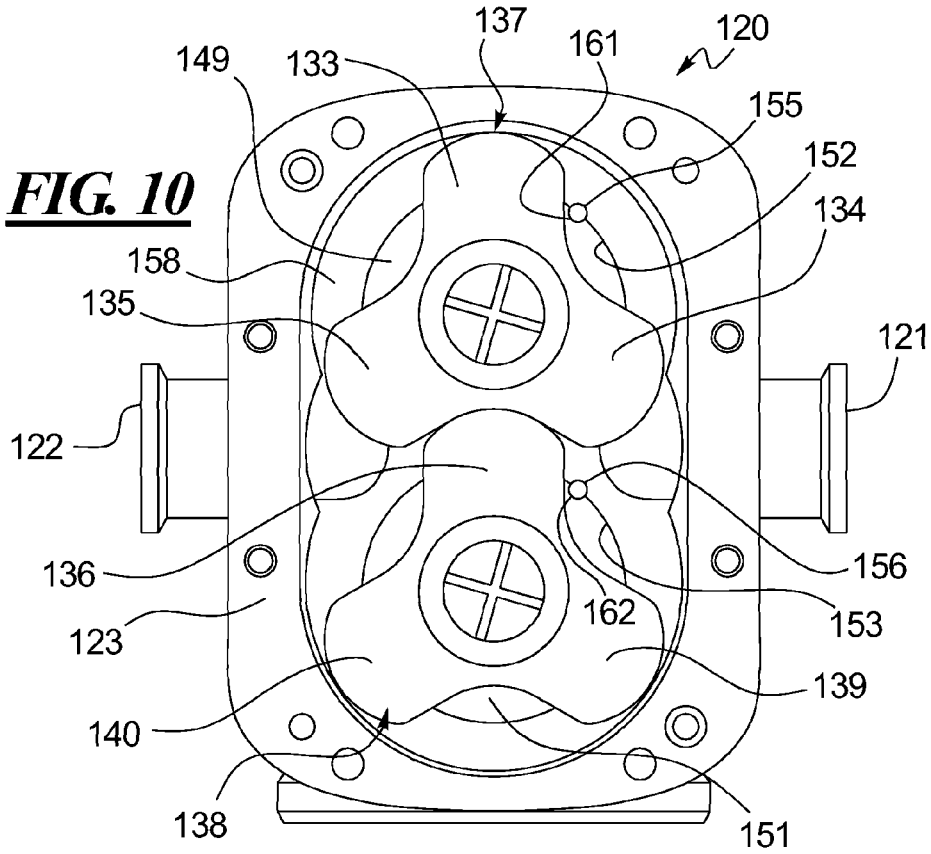
FIG. 10 is an end view of the pump illustrated in FIGS. 1-5, with the circumferential piston rotors removed and replaced by lobe rotors.

Returning to FIGS. 10-13, a pump 120 is disclosed in FIG. 10 that includes lobe rotors 137, 138 that are of the tri-lobe style or that include three lobes 133-135 and 136, 139, 140. The pump 120 also includes slots 155, 156 in the openings 152, 153 in the proximal wall 158 of the casing 123. Slots 161, 162 may also be placed in the hubs 149, 151 of the rotors 137, 138.

Figure 11:
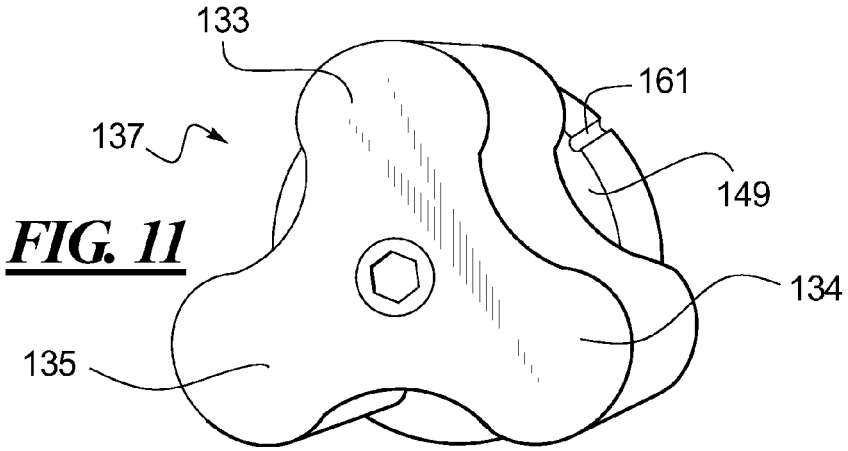
FIG. 11 is a perspective view of a tri-lobe rotor equipped with a hub with a slot disposed therein.
Figure 12:
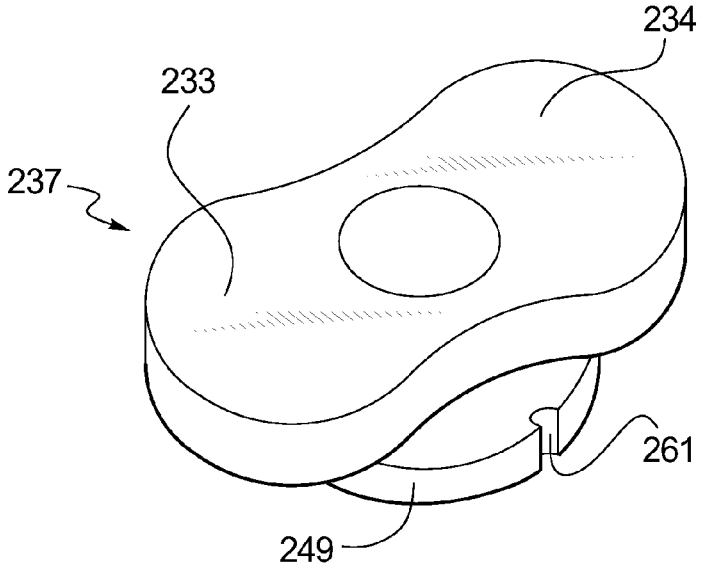
FIG. 12 is a perspective view of a dual-lobe rotor with a hub with a slot disposed therein.
Figure 13:
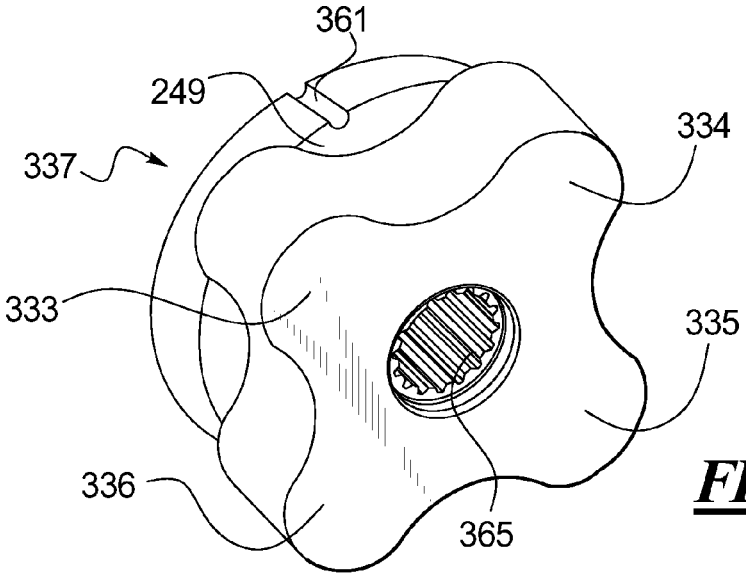
FIG. 13 is a perspective view of a quad-lobe rotor equipped with a hub with a slot disposed therein.

Three styles of lobe rotors are shown in FIGS. 11-13 with a rotor 137 being a tri-lobe type with three lobes 133-135 and a hub 149 with a slot 161. The rotor 237 is a dual-type rotor with two lobes and a slot 261 in the hub 249. Finally, the rotor 337 includes four lobes 333-336 and a hub 349 with a slot 361. The rotor 337 also includes a splined opening 365 for coupling the rotor 337 to a shaft (not shown).

INDUSTRIAL APPLICABILITY

Rotary pumps 20, 120 are disclosed which provide cooling to the seal assemblies 43, 45 without the need for an additional cooling jacket or other specialized cooling mechanism. The pumps 20, 120 may also be modified to include the disclosed cooling system as the slots 61, 62, 161, 261, 361 may be easily machined into the rotors 37, 38, 137, 237, 337 and the slots 55, 56, 155, 156 may be easily machined into the openings 52, 53, 152, 153 in the casings 23, 123.

Thus, if a pump 20, 120 needs additional cooling, the cooling may be easily provided without having to replace the pump 20, 120. Further, as original equipment, the pumps 20, 120 avoid the need for cooling jackets or other specialized cooling mechanisms.

What is claimed is:

1. A rotary pump comprising:

a casing comprising a proximal wall and an open distal end that is closed by a head to form a pump chamber, the pump chamber accommodating first and second rotors;

a drive shaft passing through a first bearing assembly and a proximal drive shaft seal before passing through a first opening in the proximal wall of the casing before being coupled to the first rotor;

a driven shaft passing through a second bearing assembly and a proximal driven shaft seal before passing through a second opening in the proximal wall of the casing before being coupled to the second rotor;

the first and second rotors each comprise a hub for accommodating the drive and driven shafts respectively, the first and second openings of the casing rotatably accommodating the hubs of the first and second rotors respectively; and the hubs of the first and second rotors each including a slot for permitting fluid to pass from the pump chamber, through the slot and past the proximal wall of the casing before reaching the proximal drive and driven shaft seals respectively.

2. The pump of claim 1 wherein the proximal wall of the casing further comprises first and second slots disposed at the first and second openings respectively for permitting fluid to pass from the pump chamber, through the first and second slots and past the proximal wall of the casing.

3. The pump of claim 1 wherein the rotors are circumferential piston rotors.

4. The pump of claim 1 wherein the rotors are lobe rotors.

5. A rotary pump comprising:

a casing comprising a proximal wall and an open distal end, the open distal end being closed by a head to form a pump chamber, the pump chamber accommodating first and second rotors;

a drive shaft passing through a first bearing assembly and a proximal drive shaft seal before passing through a first opening in the proximal wall of the casing before being coupled to the first rotor;

a driven shaft passing through a second bearing assembly and a proximal driven shaft seal before passing through a second opening in the proximal wall of the casing before being coupled to the second rotor;

the first and second rotors each comprise a hub for accommodating the drive and driven shafts respectively, the first and second openings of the proximal wall of the casing rotatably and mateably accommodating the hubs of the first and second rotors respectively; and the proximal wall of the casing further comprising first and second slots disposed at the first and second openings respectively for permitting fluid to flow from the pump chamber, through the first and second slots and past the proximal wall of the casing before reaching the proximal drive and driven shaft seals respectively.

6. The pump of claim 5 wherein the hubs of both the first and second rotors each comprise a slot for permitting fluid to flow from the pump chamber and past the proximal wall of the casing before reaching the proximal drive and driven shaft seals respectively.

7. The pump of claim 5 wherein the rotors are circumferential piston rotors.

8. The pump of claim 5 wherein the rotors are lobe rotors.

9. A circumferential piston pump comprising:

a casing comprising a proximal wall and an open distal end that is closed by a head to form a pump chamber, the proximal wall comprising first and second openings, the pump chamber accommodating first and second rotors;

a drive shaft passing through a first bearing assembly and a proximal drive shaft seal before passing through the first opening in the proximal wall of the casing before being coupled to the first rotor;

a driven shaft passing through a second bearing assembly and a proximal driven shaft seal before passing through the second opening in the proximal wall of the casing before being coupled to the second rotor;

the first and second rotors each comprise a hub for accommodating the drive and driven shafts respectively, the first and second openings of the proximal wall of the casing rotatably and mateably accommodating the hubs of the first and second rotors respectively;

each hub of the first and second rotors including a slot for permitting fluid to pass from the pump chamber, through the slot and past the proximal wall of the casing before reaching the proximal drive and driven shaft seals respectively; and the proximal wall of the casing further comprising first and second slots disposed at the first and second openings respectively for permitting fluid to pass from the pump chamber, through the first and second slots and past the proximal wall of the casing before reaching the proximal drive and driven shaft seals.

10. A rotary lobe pump comprising:

a casing comprising a proximal wall and an open distal end that is closed by a head to form a pump chamber, the pump chamber accommodating first and second rotors, the proximal wall comprising first and second openings;

a drive shaft passing through a first bearing assembly and a proximal drive shaft seal before passing through the first opening in the proximal wall of the casing before being coupled to the first rotor;

a driven shaft passing through a second bearing assembly and a proximal driven shaft seal before passing through the second opening in the proximal wall of the casing before being coupled to the second rotor;

the first and second rotors each comprise a hub for accommodating the drive and driven shafts respectively, the first and second openings of the casing mateably and rotatably accommodating the hubs of the first and second rotors respectively;

each hub of the first and second rotors including a slot for permitting fluid to pass from the pump chamber, through the slot and through the proximal wall of the casing before reaching the proximal drive and driven shaft seals respectively; and the proximal wall of the casing further comprising first and second slots disposed at the first and second openings respectively for permitting fluid to pass from the pump chamber, through the first and second slots and past the proximal wall of the casing before reaching the proximal drive and driven shaft seals respectively.

11. A method for cooling drive and driven shaft seals of a rotary pump, the method comprising:

providing a rotary pump that comprises a casing comprising a proximal wall and an open distal end that is covered by a head to form a pump chamber, the pump chamber accommodating first and second rotors, a drive shaft passing through a first bearing assembly and a proximal drive shaft seal before passing through a first opening in the proximal wall of the casing before being coupled to the first rotor, a driven shaft passing through a second bearing assembly and a proximal driven shaft seal before passing through a second opening in the proximal wall of the casing before being coupled to the second rotor, the first and second rotors each comprise a hub for accommodating the drive and driven shafts respectively, the first and second openings of the casing mateably and rotatably accommodating the hubs of the first and second rotors respectively;

placing a slot in each hub of the first and second rotors for permitting fluid to pass from the pump chamber, through the slot and past the proximal wall of the casing before reaching the proximal drive and driven shaft seals respectively.

12. The method of claim 11 further comprising placing first and second slots in the proximal wall of the casing at the first and second openings respectively for permitting fluid to pass from the pump chamber, through the first and second slots and past the proximal wall of the casing to the drive and driven proximal seals.

* * * * *